US005669352A

United States Patent [19]

Mitchell

[11] Patent Number: 5,669,352

[45] Date of Patent: Sep. 23, 1997

[54] THROTTLE CONTROL DEVICE, SYSTEM, AND METHOD

[76] Inventor: William E. Mitchell, 35 Trade Zone Dr., ronkonkoma, N.Y. 11779

[21] Appl. No.: 627,028

[22] Filed: Apr. 3, 1996

[51] Int. Cl.[6] ..... F02D 11/08

[52] U.S. Cl. ..... 123/342; 123/401

[58] Field of Search ..... 123/342, 396, 123/398, 400, 401

[56] References Cited

U.S. PATENT DOCUMENTS

| | | | |
|---|---|---|---|
| 3,923,020 | 12/1975 | Gilligan | 123/342 |
| 4,524,741 | 6/1985 | Corbi | 123/342 |
| 5,235,948 | 8/1993 | Grant | 123/342 |

OTHER PUBLICATIONS

"Bill Mitchell Hardcore Racing Products, Inc.", parts catalog, vol. 26, #1, Mar., 1995, p. 6.

*Primary Examiner*—Tony M. Argenbright
*Attorney, Agent, or Firm*—Alfred M. Walker

[57] ABSTRACT

An air/fuel control apparatus mounted on a racing automobile engine delivers fuel to the engine. A valve therein controls the flow of fuel to the engine, irrespective of the position of the accelerator foot pedal, and the valve is connected to a throttle linkage linking the pedal to the valve. The valve includes a double acting pneumatic cylinder means with a slidable piston therein. A movable shaft extends through both ends of a cylindrical housing, and moves with the piston. One first end of the shaft is coupled to the valve so that slidable movement of the piston opens and closes the valve to increase and decrease, respectively, flow of fuel to the carburetor of the engine. A cable rod connects the housing to the pedal so that movement of the pedal causes the housing to move with respect to the piston therein. A solenoid valve delivers gas under pressure selectively to one side of the piston to either increase or decrease fuel flow to the engine while at also controlling the rate of gas exhaustion from the opposite side of the piston to control the rate of movement of the piston, thereby to control the acceleration or deceleration of the engine. A second end of the shaft extends out from the opposite end of the housing and has an adjustable limiting member to limit of movement of the shaft in one direction by the limiting member contacting the housing.

17 Claims, 6 Drawing Sheets

Fig. 3
(PRIOR ART)
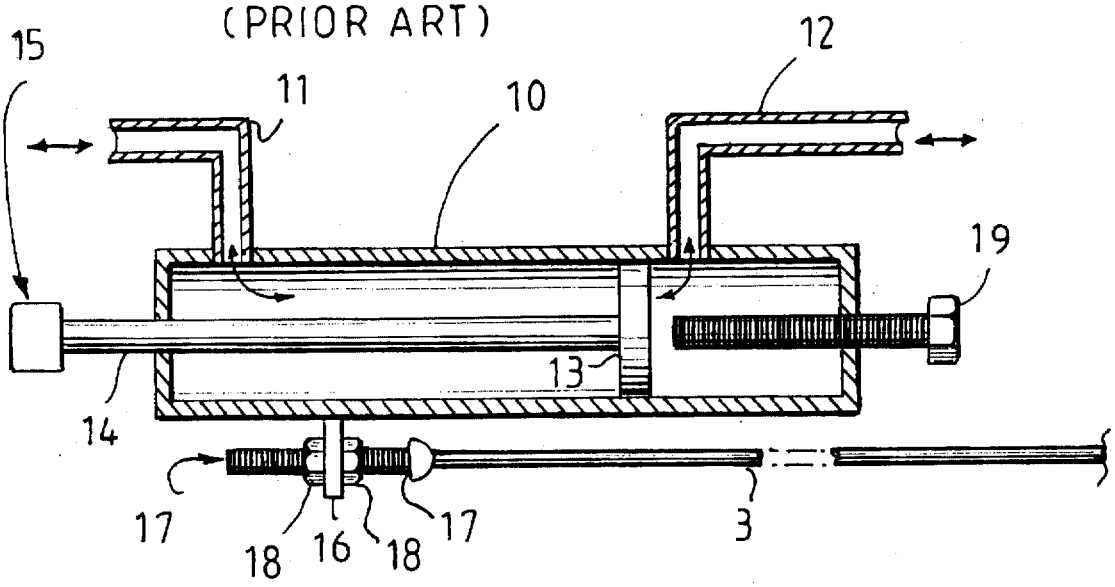
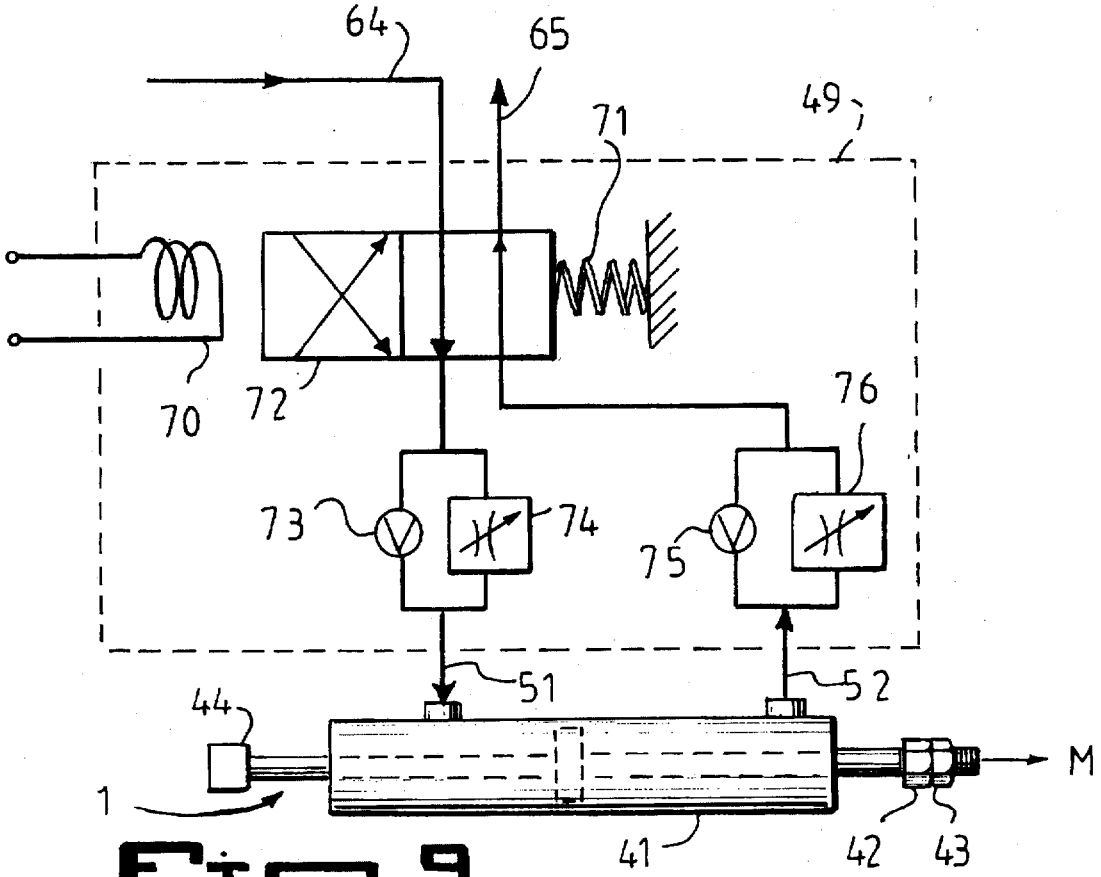
Fig. 9

3
40
41
42
43
44
45
46
47
48
49
50
51
52
60
61
62
63
64
65
66
67

THROTTLE CONTROL DEVICE, SYSTEM, AND METHOD

FIELD OF THE INVENTION

The present invention relates to a throttle valve control system for use with an internal combustion engine, and more particularly, to such a system for automatically reducing the opening of a carburetor throttle valve of the engine of a drag race vehicle for some percentage of the total duration of time in the race.

BACKGROUND OF THE INVENTION

In sanctioned drag racing there are certain classes in which the goal of the drag racer is to run a distance as close as possible to a predetermined time. For example, the distance is generally 1320 feet while the predetermined time may be 8.90 seconds. Running the distance in less time than the predetermined time disqualifies the racer. It is standard practice for these cars to race with the highest possible acceleration and the highest top speed. The car can cover the distance in a time considerably less than the predetermined time. Some type of throttle valve limiting device customarily is used to slow the car to the predetermined time of the class of the car. When the race begins, the car is under full acceleration. Some distance after the race has begun, the throttle limiting device is engaged thereby reducing throttle position for some percentage of the total duration of the time of the race to slow the vehicle down or merely to reduce the rate of acceleration, then the throttle is reopened for the balance of the race.

A throttle cable or rod typically attaches the accelerator pedal to the throttle valve in the carburetor. A variety of prior art devices have been interposed between the accelerator pedal and the throttle valve or attached to the throttle valve to selectively alter the effective length of the throttle cable or otherwise alter the position of the throttle valve to effect the desired control. Gilligan, U.S. Pat. No. 3,923,020, teaches the use of a single acting hydraulic cylinder to extend the effective length of the throttle cable thereby slowing a vehicle whenever a speed sensor detects excessive speed. Corbi, U.S. Pat. No. 4,524,741, illustrates the use of a preset throttle release based on the use of an auxiliary throttle cable with an electromagnet release device used to maximize traction at the start of a drag race. This is a manual control device which permits presetting. Current acceleration control practice generally uses some type of pneumatic cylinder driven by a supply of compressed air or compressed gas such as carbon dioxide. For example, a currently available DRT Progressive Throttle Controller uses a double-acting single ended rod carbon dioxide driven pneumatic cylinder controlled by a solenoid valve. Grant, U.S. Pat. No. 5,235,948, teaches the use of an externally adjustable single-acting single ended cylinder driven by carbon dioxide to automatically alter the effective length of the throttle cable during a drag race.

Clearly, Gilligan, U.S. Pat. No. 3,923,020, is not directly applicable to drag racing. It is a speed limiting device. The Corbi '741 device lacks the automatic engagement and disengagement features for the purpose of controlling traction. Both of these devices also lack the ability to gradually return the throttle control to full acceleration. An abrupt transition from part throttle to wide open has the unfortunate consequence of inducing tire spin and vehicle instability. While Grant '948 does have provision for selecting the transition time from part throttle to wide open, however the opposite transition from full to part throttle is not controllable. A rapid transition from full to part throttle abruptly decelerates the vehicle causing the chassis to flex and unload affecting the consistency of race performance as well as safety. The double-acting DRT Progressive Throttle Controller can be adjusted for rate of transition from full to part and back to full throttle. However, due to certain design details, it has a problem relating to ease of adjustment. The degree of throttle set-back is adjustable through the use of an adjustment bolt which also affects the effective throttle cable length; thus a compensatory adjustment of the throttle cable attachment must be made every time the set-back is adjusted. Since these critical adjustments must be made before a race and between trial runs, this is a limitation of the DRT device. These latter two prior art devices will be described in greater detail in a later section.

OBJECTS OF THE INVENTION

It is an object of this invention to provide a method and apparatus for expanding and contracting the throttle linkage at independently settable rates to achieve the desired race time.

Another object of the present invention is to provide a method and apparatus for efficiently and reliably adjusting the throttle valve control system in response to different race conditions.

Another object is to minimize the disruption of the normal throttle cable geometry by the addition of the control device.

Another object is to provide a system that is reliable and low cost.

It is yet another object to improve over the disadvantages of the prior art.

SUMMARY OF THE INVENTION

The present invention includes an air/fuel control system for an automobile, wherein the automobile includes an engine, the engine having an air/fuel means, such as a carburator or fuel injection system mounted on the engine for delivering fuel and air to said engine. The air/fuel means includes a valve, such as a butterfly throttle blade, for controlling the flow of fuel to the engine. The automobile also includes an accelerator pedal, and throttle linkage for linking the accelerator pedal to the valve. The features of the present invention includes a double acting pneumatic cylinder means with an elongated housing, such as a cylindrical housing, having a slidable piston therein for varying the effective length of the throttle linkage by varying the position of the butterfly throttle blade in the air/fuel means, to selecting limit power output of the engine.

A novel feature of the present invention includes a piston rod shaft which extends through both ends of the cylindrical housing, rather than only one end, and is engaged to move with the piston. One end of the piston rod shaft is coupled to the aforementioned throttle valve of the carburetor/fuel injection system so that slidable movement of the piston opens and closes the throttle valve to increase and decrease, respectively, flow of air and fuel to the engine. A throttle cable rod means connects to a bracket extending from the side of the cylindrical housing to the accelerator pedal so that movement of the accelerator pedal causes the cylindrical housing to move with respect to the piston therein. As the distance between the throttle valve attaching point and the linkage attaching point varies, so does the overall length of the cable rod.

A gas control solenoid valve delivers gas under pressure selectively to one side of the slidable piston, to either move the valve to increase or decrease air and fuel flow to the engine while at the same time control the rate of exhaustion of gas from the opposite side of the slidable piston, to control the rate of movement of the slidable piston, thereby to vary power output of the engine to control both the acceleration and deceleration of the automobile.

A second end of the piston rod shaft extends out from the opposite end of the cylindrical housing and has a limiting means mounted thereon for setting the limit of movement of the piston rod shaft in one direction by the limiting means coming in contact with the cylindrical housing. The limiting means comprises a limit adjusting nut on the shaft and a lock nut. Mounting the limiting means directly on the rod eliminates an external adjusting assembly.

The cable rod is connected to the forward end of the cylindrical housing on the aforementioned bracket, facing the air/fuel means. The cable rod extends parallel to the cylindrical housing from the forward end of the cylindrical housing back to the accelerator pedal for maximizing the geometry of the system for proper leverage, as opposed to the prior art of Grant '948 wherein a cable rod attaches at the back of the cylindrical housing where it is more difficult to support the weight of the device, so that leverage is compromised.

Moreover, the gas rate flow is controlled out of the cylindrical housing on both sides of the slidable piston, eliminating reliance on springs.

DESCRIPTION OF DRAWINGS

FIG. 3 is a side view crossection of the cylinder of the DRT prior art system;

DETAILED DESCRIPTION OF THE DRAWINGS

Figure 1:
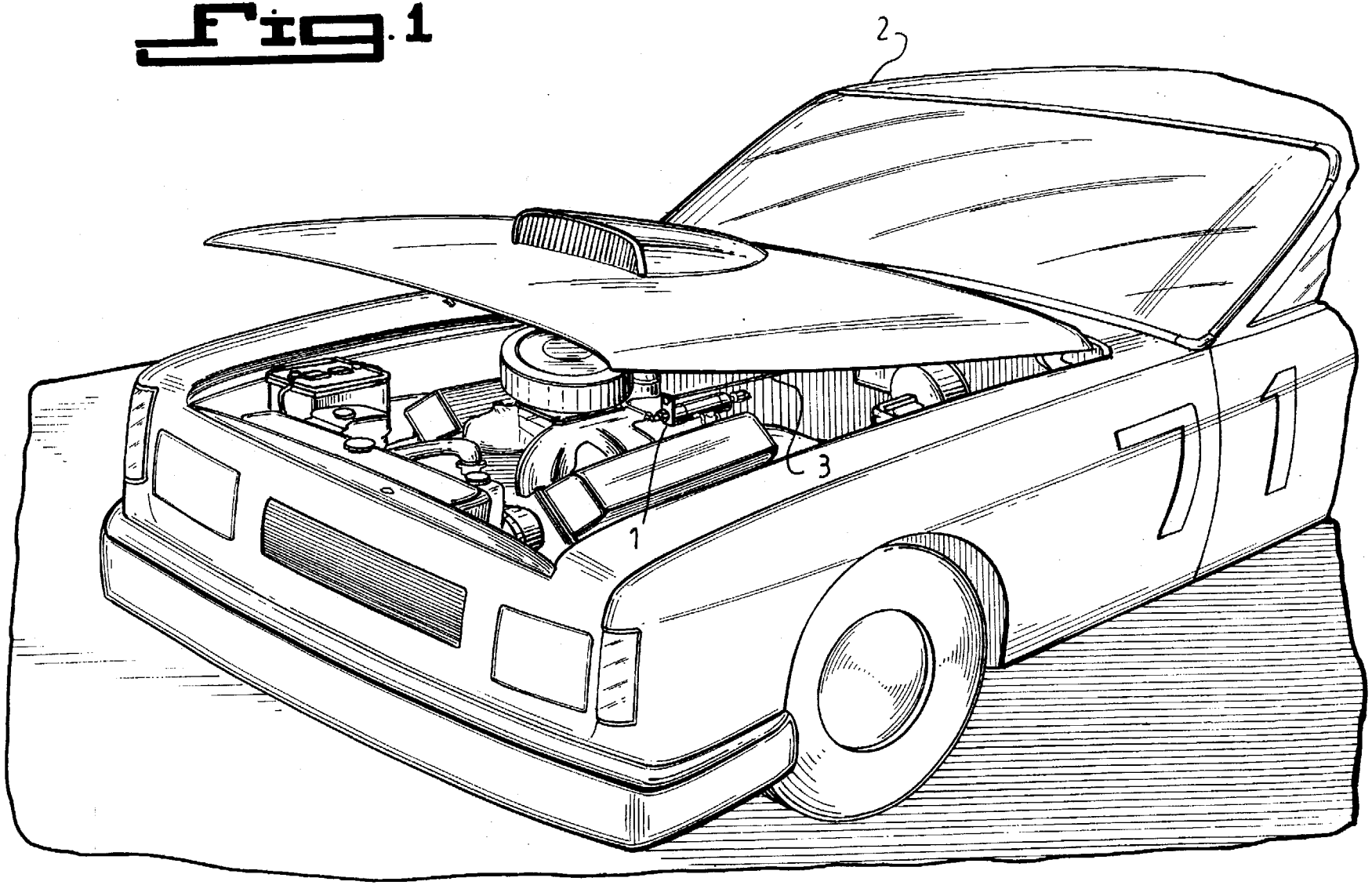
FIG. 1 is a perspective view of drag race vehicle showing throttle control device position.
Figure 2:
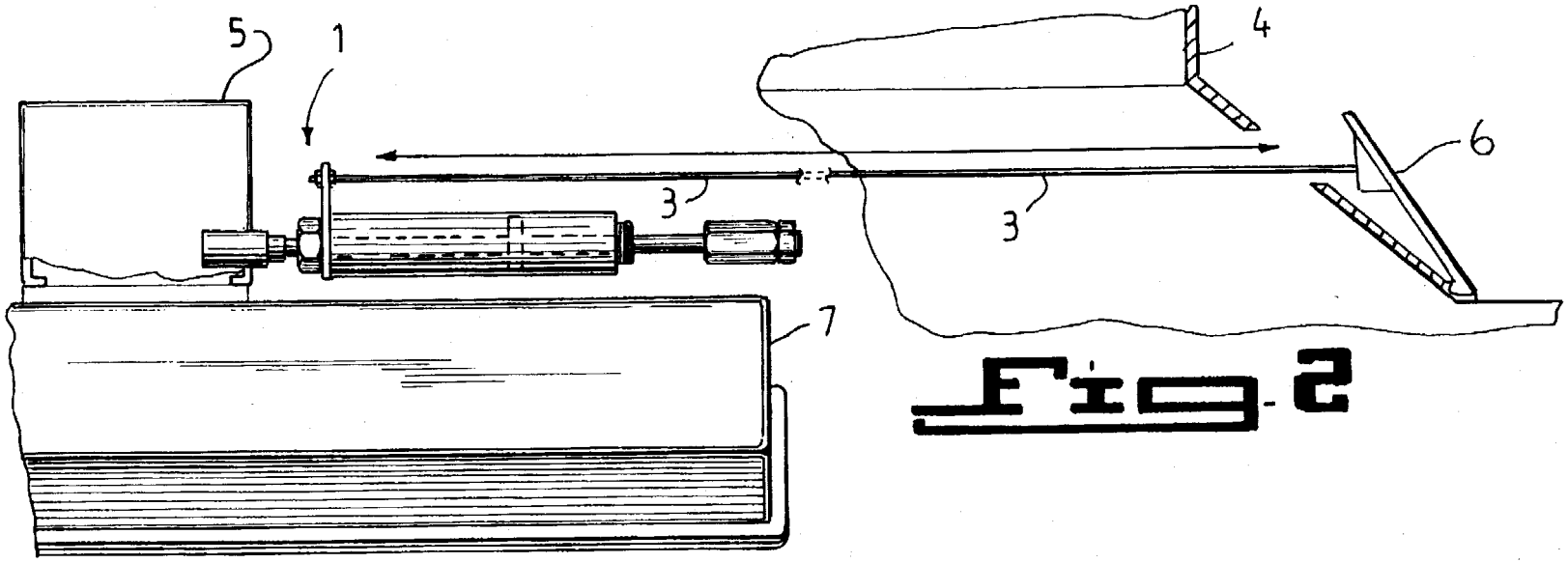
FIG. 2 is a side view of various components of the throttle control system.

FIG. 1 shows the front end of a drag race vehicle 2 with the hood partially open to reveal the cylinder subsystem 1 of the present invention attached to the throttle cable 3. FIG. 2 shows a side view of various parts of the throttle control system. The cylinder subsystem 1 is attached to the carburetor 5 at one end and to the throttle cable 3 on top. The throttle cable 3 goes through the fire wall 4 and terminates at the accelerator pedal 6. The carburetor 5 is mounted on engine 7.

A key feature of the present invention is the use of a double-acting pneumatic cylinder with a double-ended piston rod as the cylinder subsystem 1.

Figure 4:
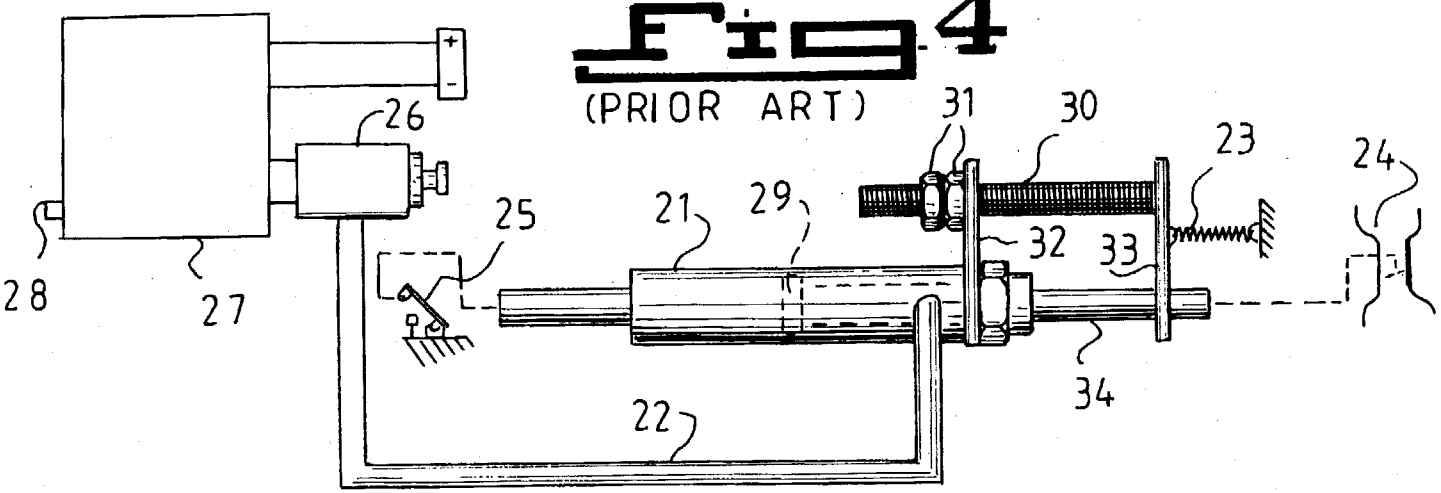
Fig. 4 (PRIOR ART)
FIG. 4 is a side view of the cylinder and related parts of the Grant prior art system.

Similar to the throttle control device of the present invention, the DRT prior art device shown in FIG. 3 uses a double-acting cylinder 10 with a single-ended rod 14. Moreover, the prior art device of Grant U.S. Pat. No. 5,235,948 shown in FIG. 4 uses a single-acting cylinder 21 with a single-ended rod 34. The cylinder of the DRT prior art device has an outer diameter of approximately 0.9 inches. In contrast, the double action cylinder 10 of the present invention has an outer diameter of 1.1 inches to increase the volume therein to move the throttle position within carburetor 5.

Figure 5:
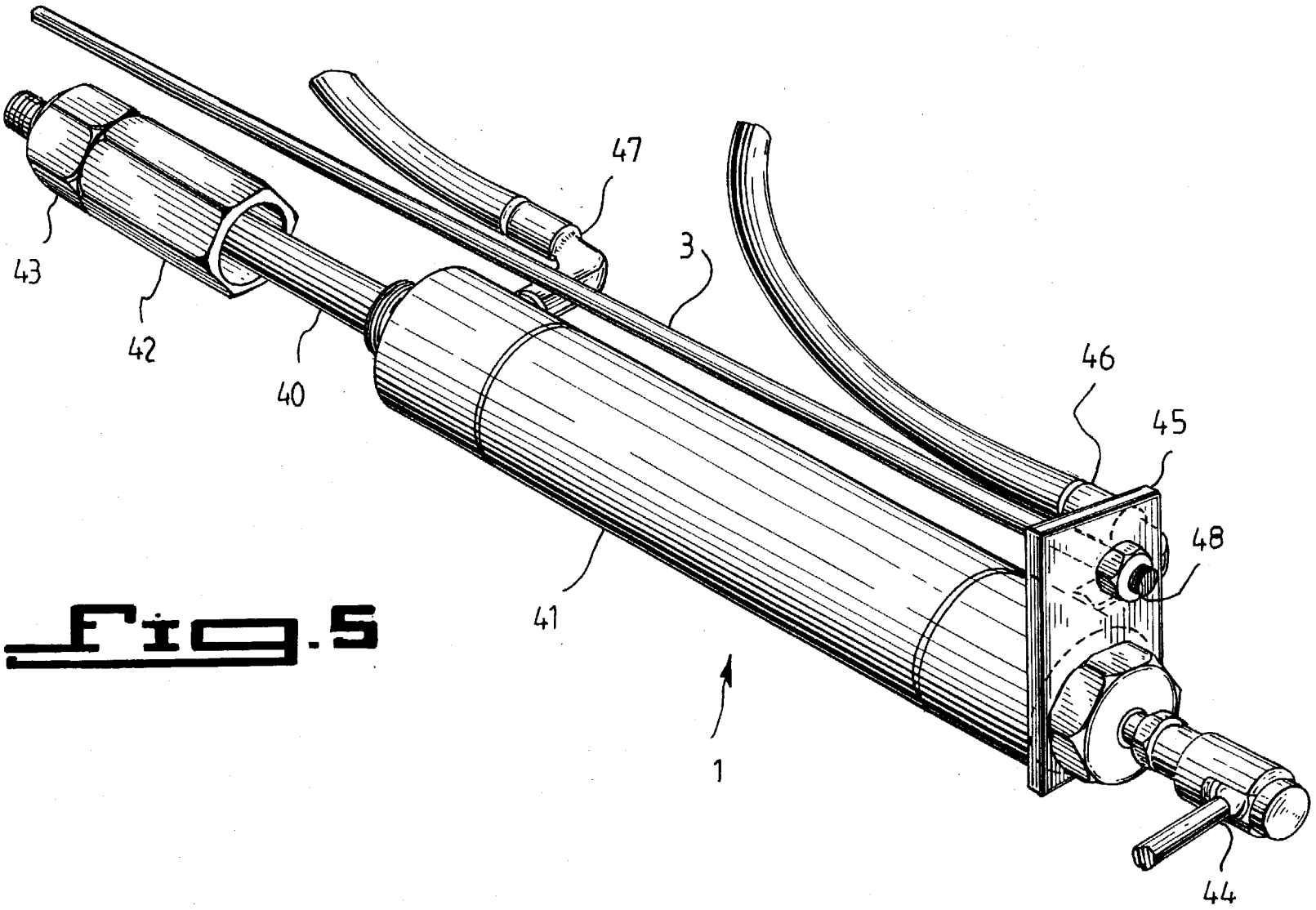
FIG. 5 is a perspective view of the cylinder subsystem.

With respect to the throttle control device of the present invention, FIG. 5 shows an enlarged perspective view of the cylinder subassembly 1 of the present invention. Double-ended piston rod 40 is shown in the retracted position, as in FIG. 2, where the effect on normal throttle operation is minimal. The adjustable throttle limiter 42 is used to adjust the extent to which the throttle control system 1 will close the throttle when fully extended. A lock nut 43 is used to lock the setting. This setting contrasts with the equivalent function in the prior art of Grant '948 FIG. 4. In Grant '948, the external non-inline adjustment screw 30 with lock nuts 31 and brackets 32 and 33 are required. In the DRT prior art device of FIG. 3, the throttle limiting device consists of bolt 19 which penetrates the cylinder 10 wall. By adjusting the stroke length of piston 13 by screw 19, the effective throttle cable length to the carburetor (attached at 15) with rod 14 fully retracted is also affected. Therefore the effective length of throttle cable 3 must always be compensated using screw 17 and lock nuts 18 to prevent either binding or slack whenever the degree of throttle limiting is adjusted.

In contrast, as seen in FIG. 2 in the throttle control subsystem 1 of the present invention, there is no interaction whatsoever between the throttle limit adjustment and the effective length of the throttle cable 3. The adjustment is direct, reliable and uses minimal parts saving both weight and cost. Also, the present invention provides a short offset and total insert length of the cylinder subassembly 1 in the path of the throttle cable 3. This geometry minimizes the effect of the presence of the cylinder 41 in the path when it is in the retracted position where it simulates the operation with the throttle control system removed. This is a beneficial distinction from the long insert length of prior art devices such as the device described in Grant '948.

In FIG. 5, cylinder 41 has throttle cable attachment bracket 45 attached at front end with throttle cable 3 secured with nuts 48. Ball joint assembly 44 attaches double-ended rod 40 to the throttle plate control of the carburetor, such as a butterfly throttle blade, (not shown). The retraction supply port 46 and the extension supply port 47 communicate with the carbon dioxide supply.

Figure 6:
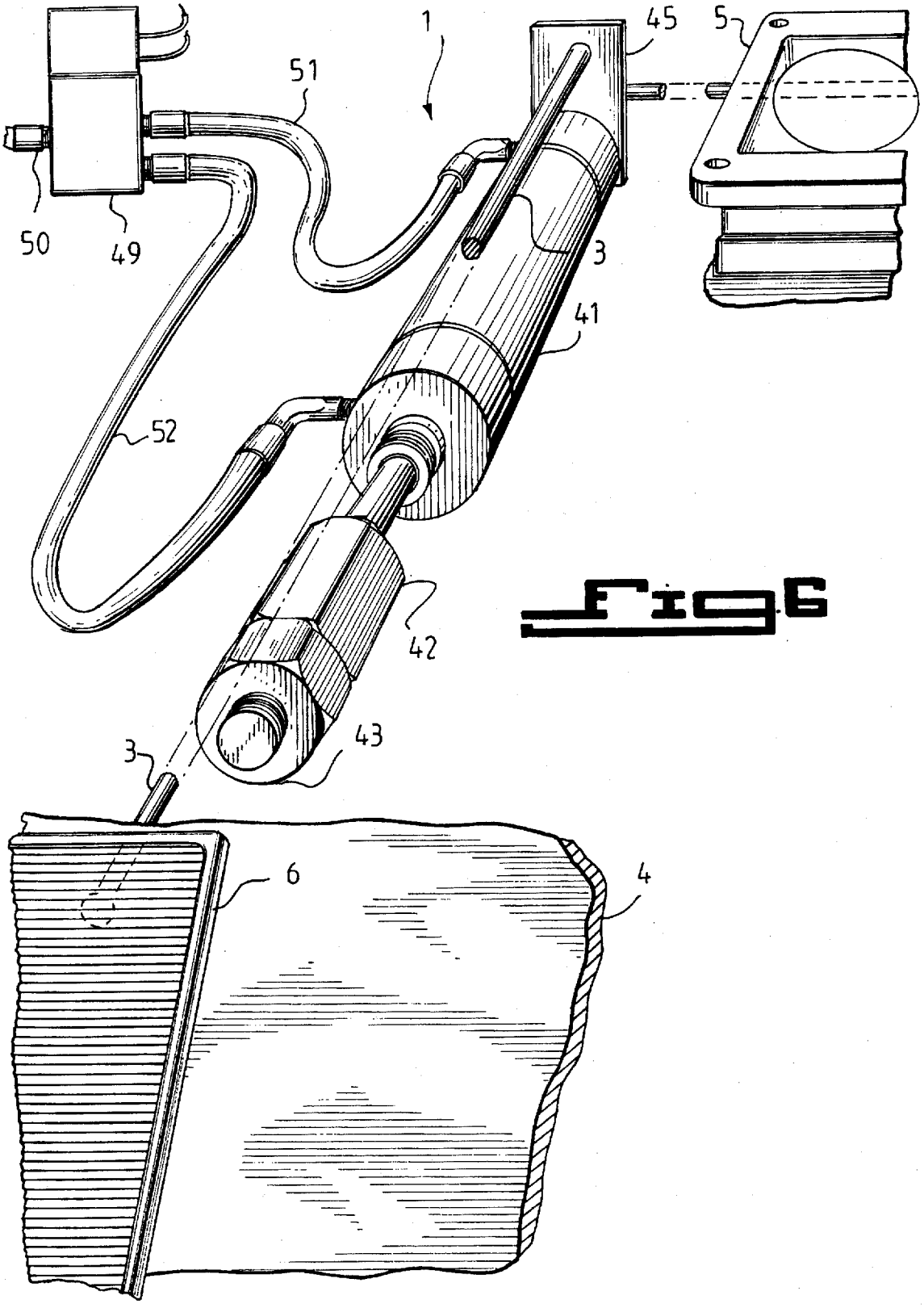
FIG. 6 is a perspective view of parts of the throttle control system.

FIG. 6 shows more of the parts of the throttle control system of the present invention. The firewall 4 and accelerator pedal 6 are shown in the foreground. The carbon dioxide supply/exhaust hoses 51 and 52 are shown attached to solenoid valve 49 with carbon dioxide supply port 50. The mechanical attachment to the throttle plate 51 in carburetor 5 is also illustrated.

Figures 7, 8:
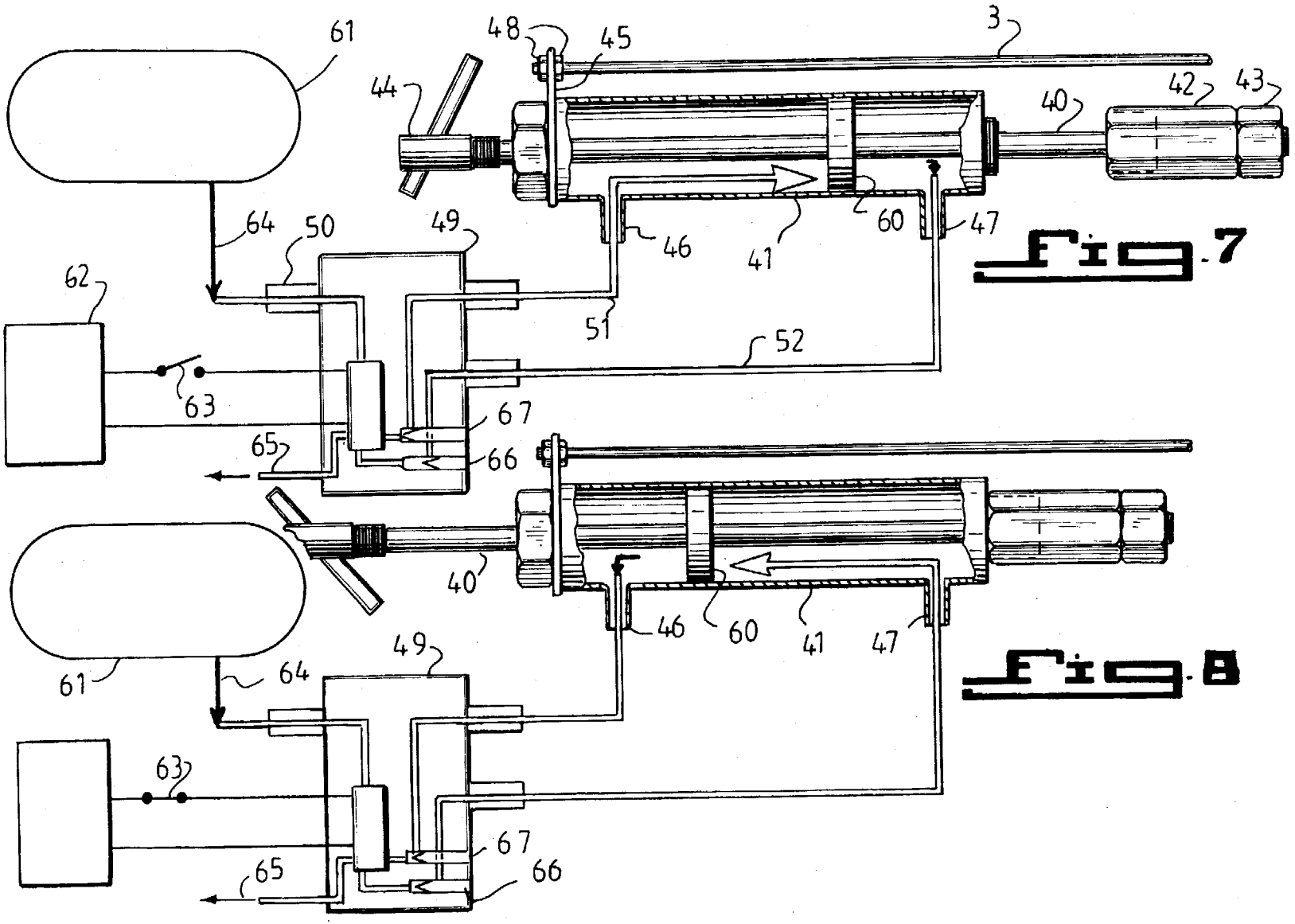
FIG. 7 is a side view crossection of the throttle control system- retraction phase.
FIG. 8 is a side view crossection of the throttle control system-expansion phase; and, FIG. 9 is a pneumatic schematic diagram of the solenoid control of the present invention.

The operation of the throttle control system is illustrated in FIG. 7. This is a view of the retraction stroke where the end of rod 40 attached to the carburetor is shortened by receding into cylinder 41 by virtue of pressurized carbon dioxide supplied to port 46 acting on piston 60 while solenoid valve 49 vents carbon dioxide from the opposite side of piston 60 through an adjustable needle valve 66 within solenoid valve 49. It is the restriction on the vented gas that regulates the speed of retraction of rod 40 since the solenoid valve supplies full pressure to port 46. Retraction of rod 40 happens when the two position solenoid valve 49 is in the unenergized position as denoted by switch 63 being shown in the open position. Actually, switch 63 is part of timer control 62; it is not a manual switch. Carbon dioxide cylinder 61 supplies compressed gas via conduit 64 to inlet port 50 on solenoid valve 49. Vent conduit 65 vents carbon dioxide to the ambient environment.

By retracting rod 40, the full acceleration potential is realized as long as the driver has the accelerator pedal fully depressed.

The expansion cycle of the effective length of throttle cable 3 in conjunction with cylinder assembly 1 is illustrated in FIG. 8. Here, switch 63 is closed thereby energizing solenoid valve 49 which now provides full pressure to port 47 of cylinder 41 pushing piston 60 to the left while exhausting carbon dioxide from port 46 through separately adjustable needle valve 67. With the rod 40 fully extended to the left as shown, the effective length of the throttle cable 3 is enlarged thereby closing down the throttle plate in the carburetor 5 and reducing acceleration of the vehicle.

FIG. 9 is a pneumatic schematic diagram of solenoid valve 49. The two-position shuttle valve element 72 is normally in the position shown as biased by return spring 71; this is the unenergized position. Solenoid coil 70 moves the shuttle to the right when energized; this substitutes the reversing paths in the pneumatic circuit. The dotted rectangle shows the housing of solenoid valve 49 and illustrates the four ports penetrating this periphery: pressure inlet supplied by conduit 64, vent conduit 65, hose 51 attaching to retraction port 46 and hose 52 attaching to port 47 of cylinder 41. Between shuttle valve 72 and hose 51 is the parallel combination of a check valve 73 and an adjustable restrictor valve or needle valve 74. A similar combination 75 and 76 is interposed between shuttle valve 72 and hose 52. While the restrictor valve (74 or 76) is a bi-directional device, the check valve (73 or 75) in parallel with it is a device with very low restriction in the forward direction and perfect sealing (i.e.—no flow) in the opposite direction. The low flow restriction direction of the check valves (73 or 74) is indicated by the arrow. The retraction cycle is depicted in FIG. 9. The operation is as follows: Pressure from conduit 64 is conveyed through the shuttle valve 72 path to the parallel combination of check valve 73 and restrictor 74. Since the flow is in the direction of the arrow in check valve 73, most of the flow bypasses the restrictor and flows through 73 to provide high pressure through hose 51 to the retraction inlet port of cylinder 41.

Simultaneously, the other path through the shuttle valve 72 conveys gas to exhaust port 65. This gas is being forced out by the piston from the right side of cylinder 41 through hose 52 into the parallel combination of check valve 75 and restrictor valve 76. Since this exhaust flow is opposite to the arrow in 75, the check valve 75 seals thereby forcing the exhaust flow through the restrictor valve 76. Thus the setting of 76 controls the rate at which the rod 40 retracts. This, in turn, shortens the effective length of the throttle control cable 3 thereby returning full control to the accelerator pedal 6. If the solenoid coil 70 is energized, the shuttle valve is switched to its alternate position where full pressure is now applied to hose 52 through check valve 75 to the expansion port of cylinder 41. Simultaneously, gas is vented through adjustable restrictor valve 74 from the left side of cylinder 41 to exhaust port 65. The rate of the elongation of the effective length of throttle cable 3 in conjunction with cylinder assembly 1 moving to the left is controlled by the setting on restrictor valve 74. This lengthens the effective length of the throttle cable 3 causing the throttle valve to close somewhat, thereby varying power output to control the vehicle's acceleration or actually slowing the vehicle.

It is noted that other modifications may be made to the present invention without departing from the scope of the invention, as noted in the appended claims.

I claim:

1. In an air/fuel control system for an automobile including an engine, an,air/fuel means mounted on the engine for delivering fuel and air to said engine, a throttle valve means in said air/fuel means for controlling the flow of air and fuel to the engine, an accelerator pedal, and throttle cable rod means for linking said accelerator pedal to said throttle valve means comprising:

(a) double acting pneumatic cylinder means having an elongated cylindrical housing with a slidable piston therein;

(b) shaft means extending through both ends of said cylindrical housing engaged to move with said piston, one end of said shaft means coupled to said throttle valve means so that slidable movement of said piston opens and closes said throttle valve means to increase and decrease, respectively, flow of air and fuel to said engine;

(c) rod means connecting said cylindrical housing to said accelerator pedal so that movement of said accelerator pedal causes said housing to move with respect to said piston therein; and (d) gas control means for delivering gas under pressure selectively to each side of said slidable piston to either move said valve means to increase or decrease air and fuel flow to said engine while at the same time controlling the rate of exhaustion of gas from the opposite side of said slidable piston to control the rate of movement of said slidable piston thereby to vary power output of the engine to control the acceleration or deceleration of said automobile.

2. The air/fuel control system of claim 1, wherein the second end of said shaft means extending out from the opposite end of said cylindrical housing has limiting means mounted thereon for setting the limit of movement of said shaft means in one direction by said limiting means coming in contact with said cylindrical housing.

3. The air/fuel control system of claim 2, wherein said limiting means comprises a limit adjusting nut on said shaft means and a lock nut.

4. The air/fuel control system of claim 2, wherein said rod means is connected to the forward end of said cylindrical housing facing said air-fuel means and comprises a rod extending parallel to said cylindrical housing from said forward end of said cylindrical housing back to said accelerator pedal for maximizing the geometry of the system for proper leverage.

5. The air/fuel system of claim 4 having a solenoid valve means to control gas rate flow out of said cylindrical housing on both sides of said slidable piston.

6. An air/fuel control system for an automobile in a drag race, wherein the automobile includes an engine, said air/fuel control system comprising a throttle control system communicating with a carburetor of the engine and the accelerator pedal of the automobile throttle control system, said throttle control system attached to the carburetor at one end for selectively and closing the flow of air/fuel therethrough at predetermined times during a race, said throttle control system including a double action bypass means for bypassing the force of a cable connecting the accelerator pedal to the carburetor, wherein said throttle control system includes a double-acting pneumatic cylinder having a double-ended piston rod movable therethrough said piston rod responsive to moving the throttle valve of the carburetor between an expanded position bypassing the flow of air and fuel thereto, and a retracted position, where the effect on normal throttle operation is minimal.

7. The air/fuel control system as in claim 6 further comprising an adjustable throttle limiter responsive to adjusting the extent to which the throttle control system closes the throttle valve when fully extended.

8. The air/fuel control system as in claim 7, wherein said cylinder has a throttle cable attachment member attached at a front end with said throttle cable rod.

9. The air/fuel control system as in claim 7 further comprising said double ended piston rod being attached to a ball joint assembly, said ball joint assembly attachable to the throttle valve of said air/fuel control system.

10. The air/fuel control system as in claim 7 wherein said cylindrical housing includes a retraction supply port and an extension supply port communicating with a supply of compressed gas, said compressed gas urging said piston rod within said cylindrical housing in both directions.

11. The air/fuel control system as in claim 10 wherein said retraction supply port and said extension supply port are attached by conduits to a said solenoid valve controlling the flow of said supply of compressed gas against said double acting piston rod.

12. The air/fuel control system as in claim 10 wherein in a retraction stroke an effective length of said piston rod attached to the carburetor is shortened by said piston rod receding into said cylinder by virtue of compressed gas being supplied to said piston rod while said solenoid valve vents the compressed gas from an opposite side of said piston rod through a valve within said solenoid valve, wherein a restriction on the vented compressed gas regulates the speed of retraction of said piston rod when said solenoid valve supplies full pressure to said retraction port.

13. The air/fuel control system as in claim 10 wherein retraction of said piston rod occurs when said solenoid valve is in an unenergized position when a switch connected thereto is in the open position.

14. The air/fuel control system as in claim 10 wherein expansion of said piston rod occurs when said solenoid valve is in an energized position when said switch connected thereto is in the closed position.

15. The air/fuel control system as in claim 10 wherein the maximum effective length of said throttle cable in conjunction with cylinder assembly occurs when said switch is closed, thereby energizing said solenoid valve to provide full pressure of said compressed gas with said cylinder, thereby pushing said piston rod in one direction while exhausting said compressed gas from said cylinder, thereby closing down said throttle of the carburetor to temporarily decelerate the automobile.

16. The air/fuel control system as in claim 10 wherein said solenoid valve includes a two-position shuttle valve element biased by a return spring in an unenergized position, wherein further a solenoid coil moves said shuttle valve between an energized closed position and an unenergized open position.

17. The air/fuel control system as in claim 10 wherein said compressed gas is carbon dioxide.

* * * * *